US009982651B2

(12) United States Patent
Woerner et al.

(10) Patent No.: US 9,982,651 B2
(45) Date of Patent: May 29, 2018

(54) LASER SPARK PLUG AND CLEANING METHOD FOR SAME

(75) Inventors: Pascal Woerner, Korntal-Muenchingen (DE); Joerg Engelhardt, Ditzingen (DE); Martin Weinrotter, Vitoria-Gasteiz (ES)

(73) Assignee: ROBERT BOSCH GMBH, Stuttgart (DE)

( * ) Notice: Subject to any disclaimer, the term of this patent is extended or adjusted under 35 U.S.C. 154(b) by 471 days.

(21) Appl. No.: 14/232,342

(22) PCT Filed: May 29, 2012

(86) PCT No.: PCT/EP2012/059957

§ 371 (c)(1),
(2), (4) Date: Jun. 6, 2014

(87) PCT Pub. No.: WO2013/007439

PCT Pub. Date: Jan. 17, 2013

(65) Prior Publication Data

US 2014/0305394 A1 Oct. 16, 2014

(30) Foreign Application Priority Data

Jul. 13, 2011 (DE) ..... 10 2011 079 043

(51) Int. Cl.
*F02P 23/04* (2006.01)
*F02B 5/00* (2006.01)

(52) U.S. Cl.
CPC ..... *F02P 23/04* (2013.01); *F02B 5/00* (2013.01); *Y10T 29/49229* (2015.01)

(58) Field of Classification Search
CPC ..... F02D 41/3041; F02P 15/02; F02P 23/045; F02P 23/04; F02P 13/00; F02B 5/00;
(Continued)

(56) References Cited

U.S. PATENT DOCUMENTS

2009/0107436 A1* 4/2009 Schultz ..... F02B 19/12 123/143 B
2009/0159031 A1 6/2009 Gruber
(Continued)

FOREIGN PATENT DOCUMENTS

DE 102008043961 * 5/2010 ..... F02P 23/04
EP 2 072 803 6/2009
(Continued)

*Primary Examiner* — Hung Q Nguyen
*Assistant Examiner* — Brian P Monahon
(74) *Attorney, Agent, or Firm* — Norton Rose Fulbright US LLP; Gerard Messina

(57) ABSTRACT

A laser spark plug, in particular for an internal combustion engine, having a combustion chamber window through which laser radiation may be emitted from an interior of the laser spark plug toward an exterior, the laser spark plug having a component which surrounds at least part of the beam path of the laser radiation in the area of the exterior. In particular, the laser spark plug, in the area of the component, has at least one channel which has at least two orifice sections and which allows fluid communication between the orifice sections, a first orifice section being situated in the area of an outer surface of the combustion chamber window, and a second orifice section being situated in a radially outer area of the laser spark plug, in particular of the component.

16 Claims, 6 Drawing Sheets

(58) Field of Classification Search
CPC ..... F02B 19/1061; F02B 19/12; F02B 19/18; Y10T 29/49229; F02M 21/0275; F23R 2900/00006
See application file for complete search history.

(56) References Cited

U.S. PATENT DOCUMENTS

| | | | | |
|---|---|---|---|---|
| 2009/0159032 | A1* | 6/2009 | Gruber | F02P 23/04 123/143 B |
| 2010/0024755 | A1* | 2/2010 | Herden | F02P 23/04 123/143 B |
| 2010/0147259 | A1* | 6/2010 | Kuhnert | F02P 23/04 123/260 |
| 2010/0260454 | A1* | 10/2010 | Mills | G02B 6/4204 385/33 |
| 2010/0275867 | A1* | 11/2010 | Weinrotter | F02P 15/00 123/143 B |
| 2011/0120404 | A1* | 5/2011 | Weinrotter | F02B 19/08 123/143 B |
| 2012/0180744 | A1* | 7/2012 | Gruber | F01P 3/16 123/169 R |
| 2012/0210969 | A1* | 8/2012 | Gruber | F02P 23/04 123/143 B |

FOREIGN PATENT DOCUMENTS

| | | |
|---|---|---|
| JP | 6 249 123 | 9/1994 |
| JP | 06249123 A * | 9/1994 |
| JP | 9 250 438 | 9/1997 |
| JP | 5588074 B2 | 9/2014 |

* cited by examiner

LASER SPARK PLUG AND CLEANING METHOD FOR SAME

SUMMARY OF THE INVENTION

The present invention relates to a laser spark plug, in particular for an internal combustion engine, having a combustion chamber window through which laser radiation may be emitted from an interior of the laser spark plug toward an exterior, the laser spark plug having a component which surrounds at least in part the beam path of the laser radiation in the area of the exterior. The present invention further relates to a cleaning method for such a laser spark plug.

BACKGROUND INFORMATION

An object of the present invention is to improve upon a laser spark plug and a cleaning method of the aforementioned type in such a way as to enable an efficient cleaning, in particular of the combustion chamber window of the laser spark plug.

This object may be achieved with a laser spark plug of the aforementioned type according to the present invention in that the laser spark plug, in the area of the component, includes at least one channel which has at least two orifice sections and allows fluid communication between the orifice sections, a first orifice section being situated in the area of an outer surface of the combustion chamber window and a second orifice section being situated in a radially outer area of the laser spark plug, particularly of the component.

The channel according to the present invention allows for the particularly advantageous application of fluid, for example, a cleaning solution or the like, to the outer surface of the combustion chamber window. The channel according to the present invention further advantageously allows a targeted introduction of the cleaning fluid into the area of the laser spark plug to be cleaned.

In one advantageous specific embodiment it is provided that a longitudinal axis of at least one longitudinal section situated in the area of the first orifice section points essentially at a radially inward lying area of an outer surface of the combustion chamber window which allows a targeted introduction of a cleaning fluid onto the optically active area of the combustion chamber window, regardless of the spatial configuration of the second orifice section of the channel. This means that a flow direction of a cleaning fluid introduced by the channel may be advantageously determined or influenced by the longitudinal axis of the first longitudinal section, in particular its orientation.

According to one further specific embodiment it may be particularly advantageously provided that the longitudinal axis of the first longitudinal section is oriented in such a way that a point of intersection of the longitudinal axis with the outer surface of the combustion chamber window includes a distance relative to the optical axis of the laser spark plug, which amounts to at least 20%, which may be at least 40%, of a radiation cross section of the laser radiation in the area of the outer surface. Based on tests conducted by the applicant, this configuration allows for a particularly efficient cleaning of the outer surface of the combustion chamber window in the surface area through which the laser radiation provided by the laser spark plug passes into the exterior.

In one further advantageous specific embodiment it is provided that at least one second longitudinal section of the channel has a diameter of from 0.5 mm to approximately 4.0 mm, in particular from approximately 1.0 mm to approximately 2.0 mm.

This channel configuration allows for an optimal application of pressurized cleaning fluid to the combustion chamber window, the cleaning fluid being capable of being injected, in particular, at a relatively high pulse (high pressure, high speed) onto the combustion chamber window and thereby cleaning the latter. In addition to applying highly pressurized cleaning fluid to the combustion chamber window, a wetting with cleaning fluid, at, for example, relatively low pressure, is also advantageously possible via the channel according to the present invention. Alternatively or in addition, a mechanical cleaning through the channel may also be carried out, for example using a brush or a cotton swab or the like.

In one further advantageous specific embodiment it is provided that a first longitudinal section of the channel situated in the area of the first orifice section has a diameter of from approximately 0.1 mm to approximately 2.0 mm, in particular from approximately 0.2 mm to approximately 1.0 mm.

If the channel according to the present invention includes, for example, different longitudinal sections, each with different cross-sectional openings or diameters, a jet effect for a cleaning fluid flowing through the channel may advantageously be achieved, thereby allowing the pulse of the cleaning agent flow to be advantageously influenced.

In one further advantageous specific embodiment, the channel is configured in such a way that it may be temporarily closed so that no fluid communication is possible between the first and the second orifice section. For example, the channel may at least in sections advantageously include an internal thread, into which a set screw may be screwed in order to prevent fluid communication between the orifice sections of the channel according to the present invention.

The channel may be particularly advantageously configured at least in sections as a stepped bore, making it possible to manufacture the laser spark plug according to the present invention particularly cost-effectively. Generally, however, the channel according to the present invention may also have a geometry of greater complexity. In particular, the channel does not necessarily have to be essentially cylindrical in shape, rather it may, for example, also include one or multiple curved longitudinal sections which make it possible to change the direction of the cleaning fluid. It is also conceivable, for example, to provide the second orifice section into which the cleaning fluid to be applied to the combustion chamber window is to be introduced, in an axial end area of the laser spark plug which faces away from the combustion chamber, whereby a cleaning fluid would also be introducible, for example, in an installation state of the laser spark plug into a cylindrical shank of an internal combustion engine.

In one advantageous specific embodiment, the laser spark plug includes a fastening arrangement in a radially outward area for mechanical connection to a target system, in particular an external thread for screwing into a corresponding internal thread of a cylinder head of an internal combustion engine. In this configuration according to the present invention, the second orifice section of the channel according to the present invention may be situated particularly in the area of the fastening arrangement in such a way that the second orifice section is closed off when the laser spark plug is installed in the target system. This advantageously ensures that in the installation position of the laser spark plug, the second orifice section situated radially on the outside of the laser spark plug is not directly connected to a combustion chamber of the internal combustion engine into which the laser spark plug projects in its installation position.

Alternatively or in addition, the channel may, as previously described above, be closed off with the aid of an appropriate closure arrangement such as, for example, a set screw.

According to one further advantageous specific embodiment, the component which surrounds at least part of the beam path of the laser radiation is configured, for example, as a diaphragm and/or a prechamber. In both cases, the relevant component impedes access to the outer surface of the combustion chamber window so that it is particularly advantageous to use the channel according to the present invention for cleaning the combustion chamber window. Advantageously, the channel may be integrated, at least in part, into the diaphragm or the prechamber wall.

A further approach to the object of the present invention is provided by a method as described and disclosed herein.

Further advantageous embodiments are the subject matter of the descriptions herein.

Additional features, applications and advantages of the present invention result from the following description of exemplary embodiments of the present invention represented in the figures of the drawing. All features described or represented herein form, by themselves or in any arbitrary combination, the subject matter of the present invention, regardless of their subsumption in the patent claims or their back-reference, and regardless of their wording or representation in the description or in the drawings.

DETAILED DESCRIPTION

Figure 1:
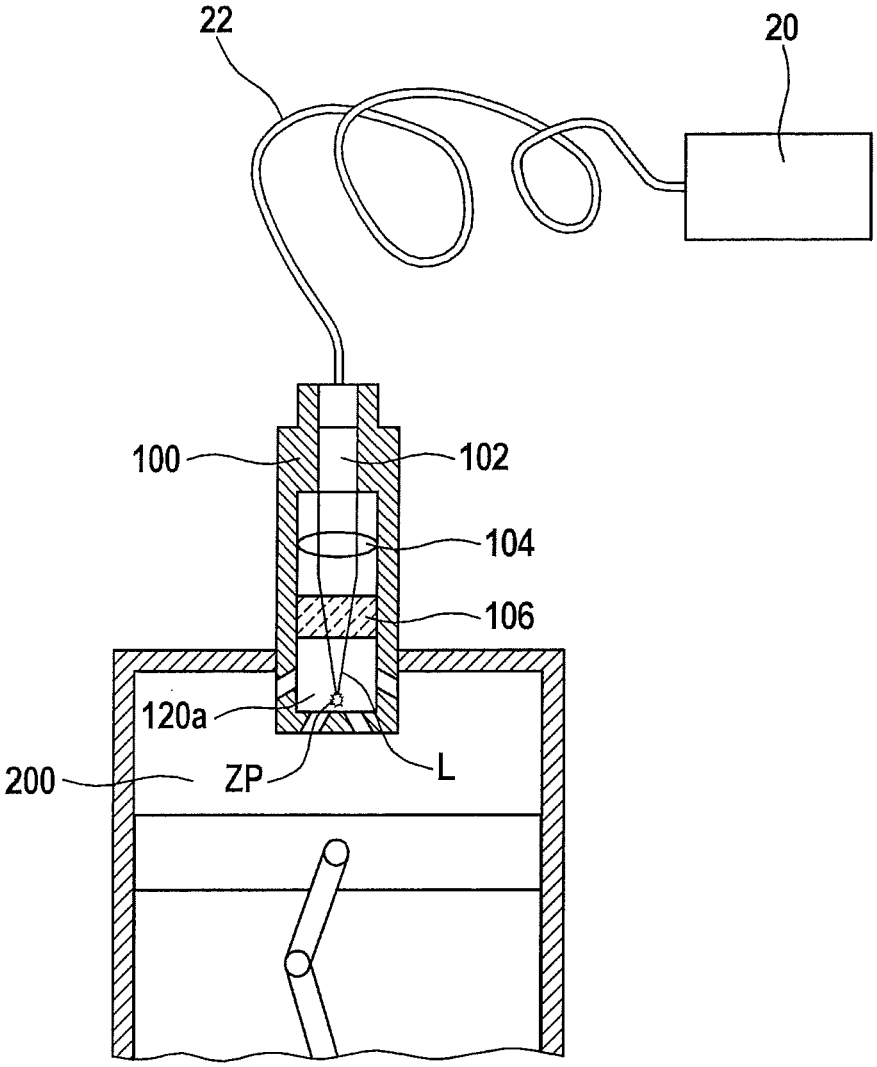
FIG. 1 schematically shows a laser-based ignition system for an internal combustion engine having a laser spark plug which includes a prechamber.

FIG. 1 schematically shows a laser-based ignition system of an internal combustion engine, in which a laser spark plug 100 is situated in the area of a cylinder head of the internal combustion engine in such a way that an end section of laser spark plug 100 facing the combustion chamber protrudes in a manner known per se into combustion chamber 200 of the internal combustion engine.

In the present case, laser spark plug 100 is supplied via a light guiding arrangement 22 with pump radiation which is provided by a pump light source 20. Laser spark plug 100 may, for example, include an integrated passive Q-switched solid state laser 102, which, when impacted by pump light from pump light source 20, generates high-energy laser ignition pulses in a manner known per se.

Situated optically downstream from solid state laser 102 are focusing optics 104 which focus the generated laser radiation on an ignition point IP situated in prechamber 120*a*. In other embodiments (cf. for example, FIG. 3), the ignition point IP is situated directly in the combustion chamber. In the present case, an interior of laser spark plug 100 is delimited in the direction of prechamber 120*a* by a combustion chamber window 106 through which laser radiation L irradiates.

Figure 2:
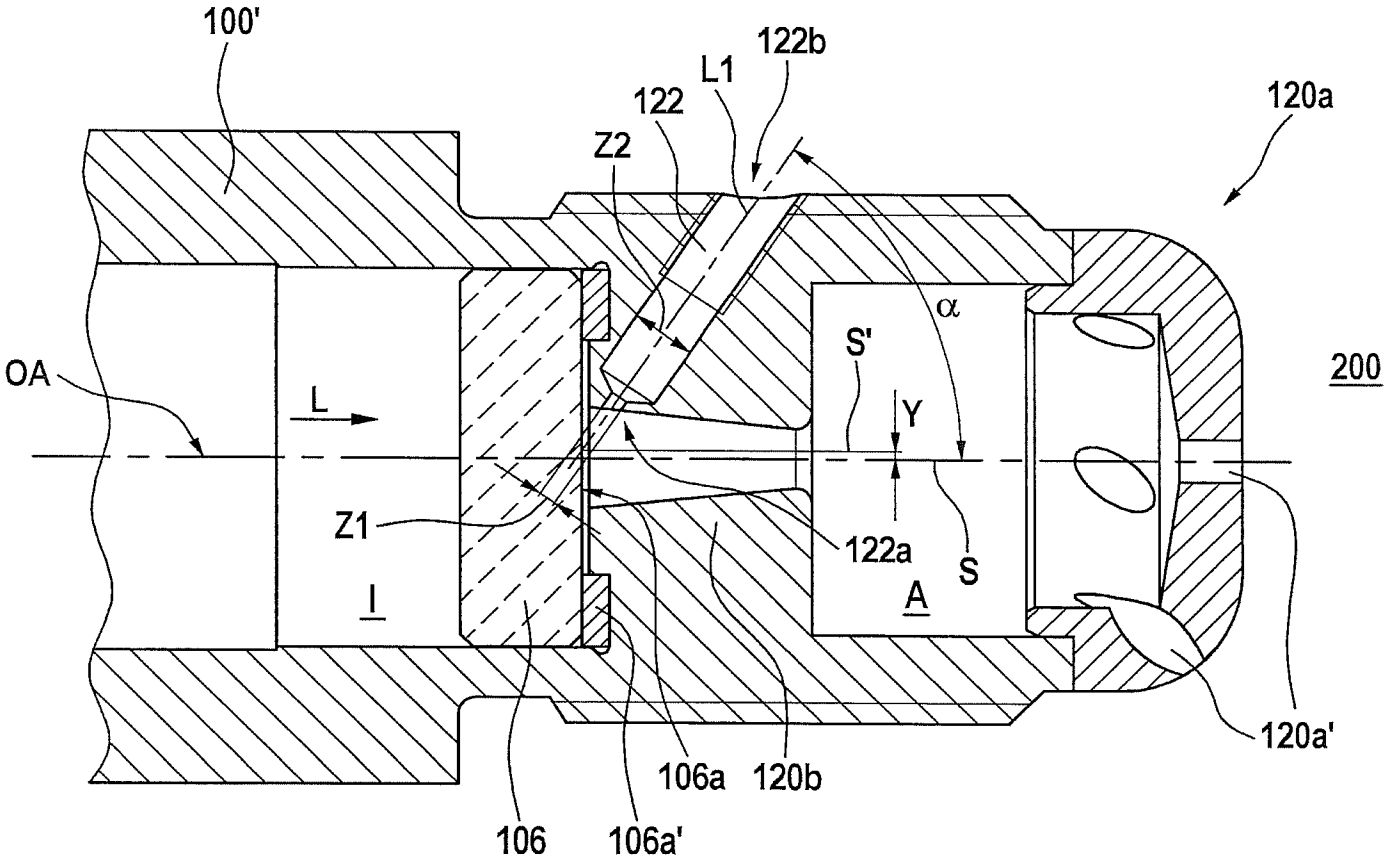
FIG. 2 schematically shows an end area of a first specific embodiment of a laser spark plug according to the present invention which faces the combustion chamber.

FIG. 2 shows a detailed view of an end area of a laser spark plug facing the combustion chamber according to one specific embodiment of the present invention.

The laser spark plug, similar to the schematic representation according to FIG. 1, includes a prechamber 120*a* into which laser radiation L may be irradiated through combustion chamber window 106 for igniting an air/fuel mixture contained in prechamber 120*a*.

To protect outer surface 106*a* of combustion chamber window 106, the laser spark plug according to FIG. 2 has a diaphragm 120*b*, also referred to as a "light path" or "light path" element. Diaphragm 120*b*, in the present case by virtue of its somewhat truncated cone-shaped orifice, makes it possible on the one hand to apply laser radiation L to prechamber 120*a* from the interior area I of the laser spark plug situated on the left in FIG. 2, while at the same time protecting outer surface 106*a* of combustion chamber window 106 against dirt particles from prechamber 120*a*, because diaphragm 120*b* shields off at least areas of outer surface 106*a* of combustion chamber window 106.

Prechamber 120*a* of the laser spark plug illustrated in FIG. 2 also includes so-called overflow channels 120*a*' which allow fluid communication between prechamber 120*a* and space 200 surrounding it, for example, combustion chamber 200 of the internal combustion engine.

In conventional laser spark plugs which have a prechamber, combustion chamber window 106, in particular outer surface 106*a*, may only be cleaned by introducing a cleaning fluid via overflow channels 120*a*' into the interior of prechamber 120*a*, from where it contacts outer surface 106*a* of combustion chamber window 106 through the opening of diaphragm 120*b*. As a result, cleaning conventional laser spark plugs having a prechamber or diaphragm is costly and is only relatively minimally effective.

Hence, according to the present invention, the laser spark plug has at least one channel 122 which includes at least two orifice sections 122*a*, 122*b* and allows fluid communication between orifice sections 122*a*, 122*b*. According to the present invention, it is provided that a first orifice section 122*a* of channel 122 is situated in the area of outer surface 106*a* of combustion chamber window 106, and that a second orifice section 122*b* of channel 122 is situated in a radially outer area of laser spark plug 100, in particular of diaphragm 120*b* or prechamber 120*a*.

In this way it is possible to introduce, particularly advantageously in the radially outward area of laser spark plug 100, a cleaning fluid from outside into channel 122 which is guided through channel 122 directly to surface area 106*a* to be cleaned of combustion chamber window 106.

This means that during cleaning of laser spark plug 100 according to the present invention, a fluid transport of cleaning fluid takes place from exterior 200 or the radially outward area of prechamber 120*a* through channel 122 onto outer surface 106*a* of combustion chamber window 106. Cleaning fluid deflected from outer surface 106*a* may exit the laser spark plug or prechamber 120*a* advantageously through overflow channels 120*a'*.

In one further advantageous specific embodiment at least two channels 122 according to the present invention are provided, at least one first channel 122 capable of being used to deliver cleaning fluid to combustion chamber window 106, with at least one additional channel (not shown) being used to drain the delivered cleaning fluid from the area of prechamber 120*a* into exterior 200.

Channel 122 according to the present invention may also have more than two orifice sections and thus, for example, may have a Y-shaped branching (not shown) and the like, at least two orifice openings 122*a*, 122*b* as described above to be arranged to allow easy cleaning of combustion chamber 106 from outside laser spark plug 100.

Figure 5:
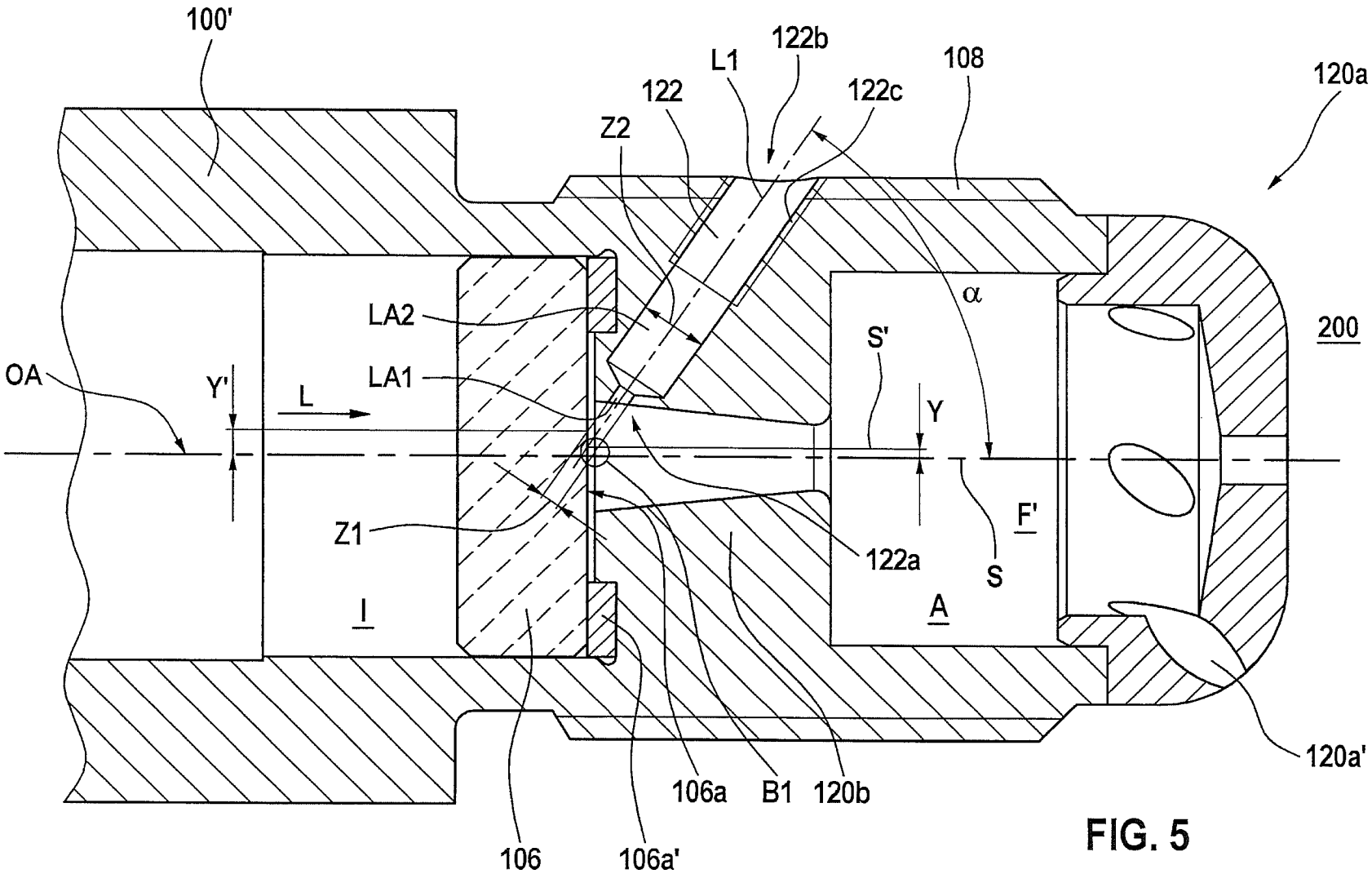
FIG. 5 shows a detailed view of an end section of a laser spark plug according to the present invention which faces the combustion chamber, according to another specific embodiment.

In one further particular specific embodiment of the invention, see the detailed view in FIG. 5, it is provided that a longitudinal axis of at least one first longitudinal section LA1 of channel 122 situated in the area of first orifice section 122*a* points essentially at a radially inward lying area B1 of outer surface 106*a* of combustion chamber 106 so that it allows cleaning fluid to be efficiently applied to combustion chamber window 106.

In one particular specific embodiment, it is provided that the longitudinal axis of first longitudinal section LA1 is oriented in such a way that a point of intersection of the longitudinal axis with outer surface 106*a* of combustion chamber window 106 includes a distance Y (FIG. 2) relative to optical axis OA of laser spark plug 100, which amounts to at least 20%, which may be at least 40%, of a radiation cross section of laser radiation L in the area of outer surface 106*a*. This essentially eccentric impact on combustion chamber window 106 results in a particularly good cleaning effect.

In one further advantageous specific embodiment, see FIG. 5, it is provided that at least one second longitudinal section LA2 of channel 122 has a diameter Z2 of from approximately 0.5 mm to approximately 4.0 mm, in particular from approximately 1.0 mm to approximately 2.0 mm.

In one further advantageous specific embodiment, it is provided that longitudinal section LA1 of channel 122 situated in the area of first orifice section 122*a* has a diameter Z1 of from approximately 0.1 mm to approximately 2.0 mm, in particular from approximately 0.2 mm to approximately 1.0 mm.

Figure 3:
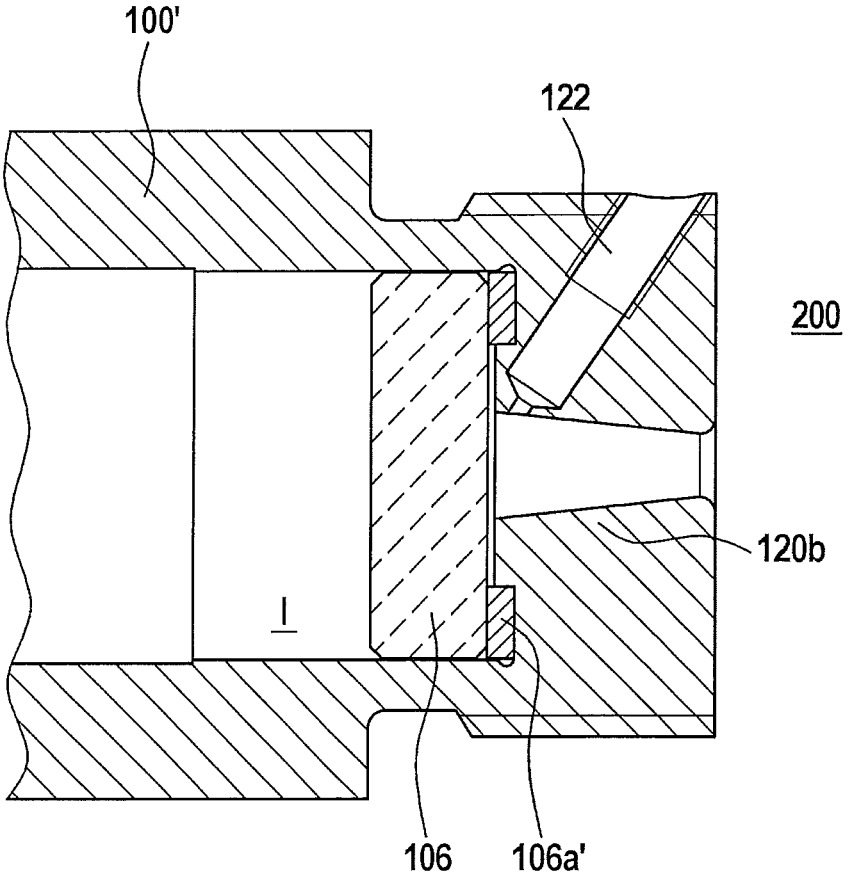
FIG. 3 schematically shows a partial cross section of one further specific embodiment according to the present invention.

FIG. 3 shows one further specific embodiment of the laser spark plug according to the present invention in which the laser spark plug is fitted not with a prechamber 120*a* (FIG. 2), but rather with a diaphragm 120*b*. Even in this invention variant at least one channel 122 may be provided for applying cleaning fluid to outer surface 106*a* of combustion chamber 106. As is apparent from FIG. 3, diaphragm 120*b* may also be configured as one piece with housing 100' of the laser spark plug.

Figure 4:
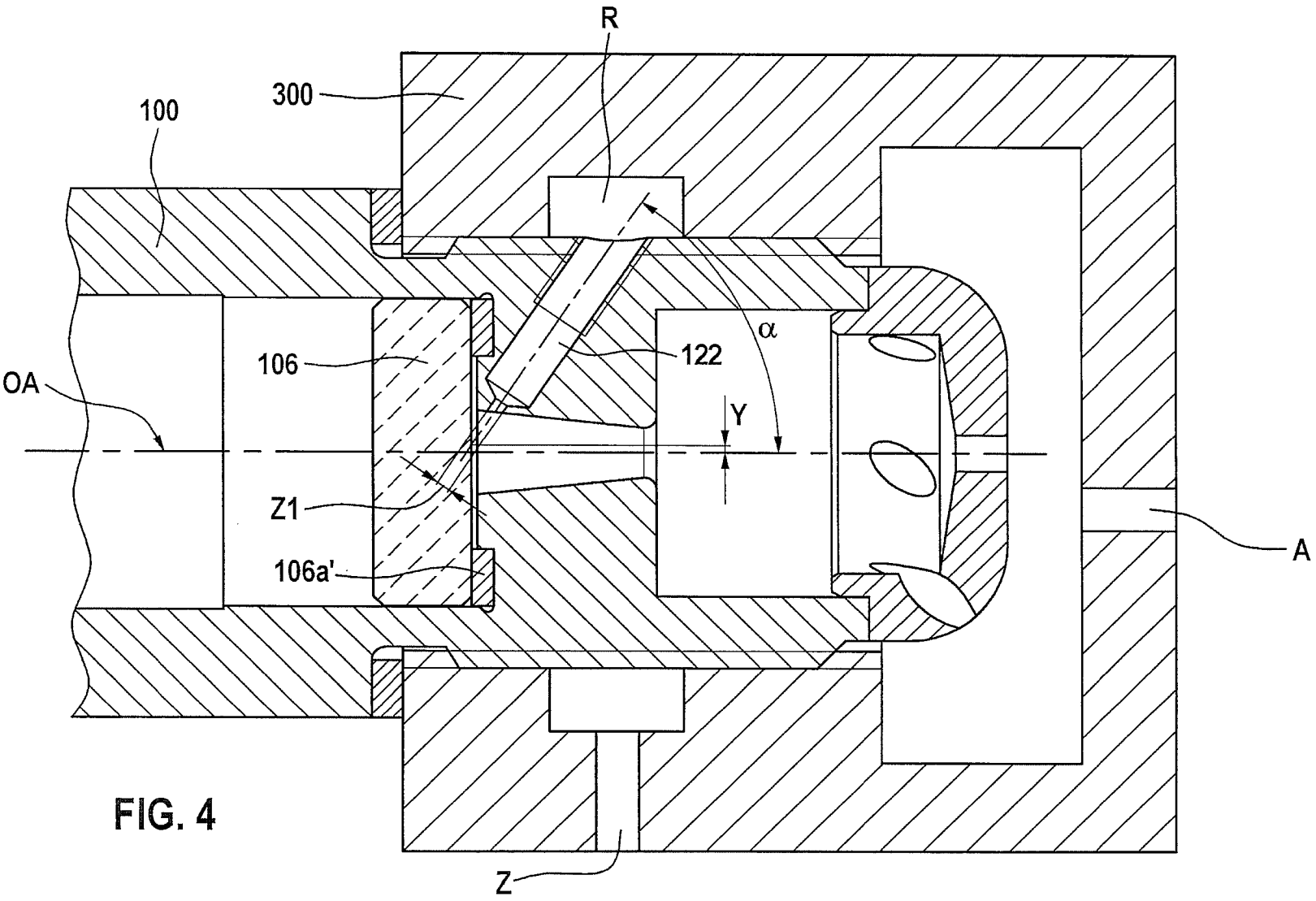
FIG. 4 schematically shows a partial cross section of a laser spark plug according to the present invention to which a cleaning device is attached.

FIG. 4 shows a laser spark plug 100 according to the present invention having channel 122 according to the present invention, which, due to its suitability for cleaning laser spark plug 100 and its combustion chamber window 106, is also referred to as a flushing channel, and a cleaning device 300 situated around the end area of laser spark plug 100 which faces the combustion chamber. Cleaning device 300 includes an inlet Z for delivering cleaning fluid which is guided via inlet Z into an annular groove R. Cleaning device 300 may be mechanically connected to laser spark plug 100 in such a way that fluid communication is also established between annular groove R and flushing channel 122 according to the present invention, see FIG. 4. In this way the cleaning fluid delivered to cleaning device 300 passes from inlet Z via annular groove R into flushing channel 122 and thus onto the outer surface of combustion chamber window 106.

A return flow of the cleaning fluid applied to combustion chamber window 106 to outlet A of cleaning device 300 may take place in the configuration illustrated in FIG. 4 via the overflow channels of the prechamber. The used fluid may be filtered, re-pressurized and delivered again to inlet Z, thereby advantageously resulting in a cleaning fluid circulation.

Cleaning device 300 may advantageously also include an arrangement for tempering, in particular heating, of the cleaning fluid, which may result in the shortening of a cleaning period. The heater may be advantageously configured in such a way that the cleaning fluid is heated to below boiling point or also at most up to a predefinable limit of approximately 50° C. in order to prevent burns when handling device 300.

As previously mentioned, FIG. 5 shows a detailed view of an end area of laser spark plug 100 according to the present invention which faces the combustion chamber. A first longitudinal section LA1 of channel 122 according to the present invention is, as is apparent from FIG. 5, oriented in such a way that it points essentially at a radially inward center area of outer surface 106*a* of combustion chamber window 106, making possible a precise application of cleaning fluid to the optically active outer surface of combustion chamber window 106. If first longitudinal section LA1 has a smaller diameter than at least one further second longitudinal section LA2 connected thereto in the axial direction of channel 122, a jet effect for fluid flowing through channel 122 may be caused in a manner known per se so that it may influence a flow rate of cleaning fluid streaming onto combustion chamber window 106. In the present case, first longitudinal section LA1 has a first diameter Z1, and second longitudinal section LA2 has a second diameter Z2>Z1. The configuration of channel 122 illustrated in FIG. 5 may be advantageously configured as a stepped bore, making it possible to produce the laser spark plug according to the present invention and its housing 100' particularly economically.

The outer orifice or outer orifice section 122*b* of channel 122 is particularly advantageously situated in the area of an external thread 108, with which laser spark plug 100 may be screwed into a cylinder head. This advantageously ensures that channel 122 is sealed off from its surroundings while laser spark plug 100 is screwed into the cylinder head.

Alternatively or in addition, an internal thread 122*c* may also be provided in channel 122, into which a set screw may be screwed in order to seal off channel 122.

Angle α of channel 122 or at least its end section facing combustion chamber window 106 or its longitudinal axis LA1 is, in one further specific embodiment, advantageously selected in such a way that a point of intersection of the corresponding longitudinal axis with outer surface 106*a* of combustion chamber window 106 extends a distance Y relative to optical axis OA or beam path S of laser spark plug 100, which amounts to at least approximately 20%, which may be at least approximately 40%, of a beam cross section of laser radiation L in the area of outer surface 106*a*, see reference symbol S' in FIG. 5, resulting in a particularly efficient cleaning.

Alternatively, the degree of distance between a point of intersection of the outer edge of channel 122 in area 122*a* with combustion chamber window 106 and optical axis OA or beam path S may be selected to be so large that it corresponds to the laser beam radius on outer surface 106*a* or to at least approximately 75% thereof, see reference symbol Y' in FIG. 5.

According to the present invention, the cleaning fluid may be introduced with a tube or a lance which may be screwed directly or with a flange in an internal thread of flushing channel 122. Thereafter, the cleaning fluid may, as previously described, exit the laser spark plug or its prechamber via "light path"-element 120*b* or overflow channels 120*a'*.

In the design of channel 122 having at least two different cross sections, it may be advantageously ensured that when using a lance which is inserted from the outside into channel 122, the lance may not be inserted so deeply into channel 122 that it comes into contact with combustion chamber window 106. In addition, this allows the position of the lance to be precisely determined.

A weak, aqueous acid may be provided as a cleaning fluid for use with the at least one channel 122 according to the present invention, for example, an aqueous solution of acetic acid, in particular a 30% acetic acid solution. Alternatively, the cleaning fluid may also contain between approximately 10% and approximately 80%, which may be between 15% and approximately 50% acetic acid ($C_2H_4O_2$) diluted in water ($H_2O$).

All other aqueous acids which are weakened or diluted to the point that they do not attack the laser spark plug or combustion chamber window 106 itself may likewise be considered, in particular if they are able to dissolve oil ash such as, for example, calcium sulphate (anhydride) or calcium phosphate compounds.

Figure 6:
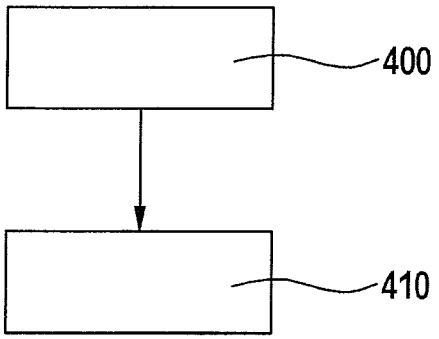
FIG. 6 schematically shows a simplified flow chart of one specific embodiment of the method according to the present invention.

FIG. 6 shows a simplified flow chart of one specific embodiment of the method according to the present invention. In a first step 400 a lance (not shown) is inserted from the outside into channel 122 (FIG. 1) in order to supply channel 122 with a cleaning fluid.

In a subsequent step 410 the cleaning fluid is injected under pressure from the lance into channel 122 and finally onto combustion chamber window 106, then drained through the conical aperture of diaphragm 120*b* (FIG. 5) or overflow channels 120*a'* out of laser spark plug 100 or interior I' of prechamber 120*a*.

In one further specific embodiment at least one further step may also advantageously follow after step 410, for example, rinsing with a neutral liquid, for example, purified water, ethyl alcohol (ethanol), isopropanol, in order to protect the spark plug from corrosion. A quick drying liquid that evaporates without residue is advantageous.

What is claimed is:

1. A laser spark plug, for an internal combustion engine, having a combustion chamber window through which laser radiation is irradiatable from an interior of the laser spark plug toward an exterior, comprising: a component which surrounds at least part of a beam path of the laser radiation in an area of the exterior, the component including a first channel through which the laser radiation is directed; at least one second channel, in the area of the component, which includes at least two orifice sections and which allows fluid communication between the orifice sections; a first orifice section situated in the area of an outer surface of the combustion chamber window; and a second orifice section situated in a radially outer area of the laser spark plug, wherein: a longitudinal axis of the first orifice section and a longitudinal axis of the second orifice section are coaxial; the combustion chamber window delimits an interior side and an exterior side of the laser spark plug; a combustion chamber of the internal combustion engine is located in the exterior side of the laser spark plug; the entire first channel and the entire at least one second channel are located in the exterior side of the laser spark plug; the second channel is configured at least in sections as a stepped bore; the first channel has a first opening, a second opening, and an inner surface that delimits the first channel: the laser radiation passes through the first opening and the second opening of the first channel; the first orifice section of the second channel has a first orifice opening which allows fluid communication between the second channel and the first channel; and the first orifice opening is formed on the inner surface of the first channel between the first opening and the second opening of the first channel, wherein a longitudinal axis of at least one first longitudinal section of the second channel situated in the area of the first orifice section points at a radial inward lying area of an outer surface of the combustion chamber window.

2. The laser spark plug of claim 1, wherein the longitudinal axis of the first longitudinal section is oriented so that a point of intersection of the longitudinal axis with the outer surface of the combustion chamber window includes a distance relative to an optical axis of the laser spark plug which amounts to at least 20 percent of a radiation cross section of the laser radiation in the area of the outer surface.

3. The laser spark plug of claim 1, wherein at least one second longitudinal section of the second channel has a diameter of from 0.5 mm to 4.0 mm.

4. The laser spark plug of claim 1, wherein one or the first longitudinal section of the second channel situated in the area of the first orifice section has a diameter of from 0.1 mm to 2.0 mm.

5. The laser spark plug of claim 1, wherein the second channel has at least in sections an internal thread, for receiving a set screw.

6. The laser spark plug of claim 1, wherein the laser spark plug includes a fastening arrangement in a radially outer area for mechanically connecting to a target system, and wherein the second orifice section is situated in the area of the fastening arrangement.

7. The laser spark plug of claim 1, wherein the component includes at least one of a diaphragm and a prechamber.

8. A method for cleaning a laser spark plug, for an internal combustion engine, the method comprising: emitting, through a combustion chamber window, laser radiation from an interior of the laser spark plug toward an exterior, the laser spark plug having a component which surrounds at least part of the beam path of the laser radiation in an area of the exterior, the component including a first channel through which the laser radiation is directed, wherein the laser spark plug in an area of the component has at least one second channel which has at least two orifice sections and which allows fluid communication between the orifice sections, a first orifice section being situated in the area of an outer surface of the combustion chamber window, and a second orifice section being situated in a radially outer area of the component of the laser spark plug; and applying at least one of a cleaning fluid and an ultrasound to the second orifice section, wherein: a longitudinal axis of the first orifice section and a longitudinal axis of the second orifice section are coaxial; the combustion chamber window delimits an interior side and an exterior side of the laser spark plug; a combustion chamber of the internal combustion engine is located in the exterior side of the laser spark plug; the entire first channel and the entire at least one second channel are located in the exterior side of the laser spark plug; the second channel is configured at least in sections as a stepped bore; the first channel has a first opening, a second opening, and an inner surface that delimits the first channel; the laser radiation passes through the first opening and the second opening of the first channel; the first orifice section of the second channel has a first orifice opening which allows fluid communication between the second channel and the first channel; and the first orifice opening is formed on the inner surface of the first channel between the first opening and the second opening of the first channel, wherein a longitudinal axis of at least one first longitudinal section of the second channel situated in the area of the first orifice section points at a radial inward lying area of an outer surface of the combustion chamber window.

9. The method of claim 8, wherein a lance is inserted at least partly into the second orifice section to deliver the at least one of the cleaning fluid and the ultrasound.

10. The laser spark plug of claim 1, wherein the longitudinal axis of the first longitudinal section is oriented so that a point of intersection of the longitudinal axis with the outer surface of the combustion chamber window includes a distance relative to an optical axis of the laser spark plug which amounts to at least 40 percent of a radiation cross section of the laser radiation in the area of the outer surface.

11. The laser spark plug of claim 1, wherein at least one second longitudinal section of the second channel has a diameter of from 1.0 mm to 2.0 mm.

12. The laser spark plug of claim 1, wherein one or the first longitudinal section of the second channel situated in the area of the first orifice section has a diameter of from 0.2 mm to 1.0 mm.

13. The laser spark plug of claim 1, wherein the second channel is situated on a side of the combustion chamber window facing a combustion chamber of the internal combustion engine.

14. The method of claim 8, wherein the second channel is situated on a side of the combustion chamber window facing a combustion chamber of the internal combustion engine.

15. The laser spark plug of claim 13, wherein the second channel includes at least in sections an internal thread for receiving a set screw.

16. The method of claim 14, wherein the second channel includes at least in sections an internal thread for receiving a set screw.

* * * * *